US007296528B1

(12) United States Patent
Doyle et al.

(10) Patent No.: US 7,296,528 B1
(45) Date of Patent: Nov. 20, 2007

(54) ANGLED LANDING PLATFORM

(75) Inventors: Christopher J. Doyle, Panama City Beach, FL (US); Robert W. James, Panama City Beach, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/489,810

(22) Filed: Jul. 10, 2006

(51) Int. Cl.
*B63C 1/02* (2006.01)

(52) U.S. Cl. ..... 114/258; 414/137.9

(58) Field of Classification Search ..... 114/45, 114/258; 414/137.9
See application file for complete search history.

(56) References Cited

U.S. PATENT DOCUMENTS 3,765,463 A * 10/1973 Gassett et al. ..... 141/388
4,075,860 A * 2/1978 Hansen ..... 405/196
4,106,637 A * 8/1978 Marsden ..... 414/138.1
4,770,589 A * 9/1988 Bryan ..... 414/140.8
5,215,024 A * 6/1993 McAllister ..... 114/45
6,334,401 B1 * 1/2002 Sridhar ..... 114/256
6,539,887 B1 * 4/2003 Vollmerhausen ..... 114/258
2002/0164231 A1 * 11/2002 Lucas et al. ..... 414/137.4
2007/0151499 A1 * 7/2007 Maloney et al. ..... 114/259

* cited by examiner

*Primary Examiner*—Stephen Avila
(74) *Attorney, Agent, or Firm*—James T. Shepherd

(57) ABSTRACT

A platform for providing an interface between a host vessel and ship-to-shore craft has a water buoyant surface that is transportable on the host vessel, an angled deck within the surface, an inner and outer ramp, and an inner and outer deck of different deck heights within the platform.

20 Claims, 5 Drawing Sheets

ANGLED LANDING PLATFORM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention pertains to watercraft platforms on ships.

2. Brief Description of the Related Art

Vessels without protected well-deck areas experience functional and safety problems while conducting roll-on/roll-off (RO/RO) and load-on/load-off (LO/LO) operations because of the instability of the ship-to-surface craft interface. Landing platforms alongside the sea-going vessel remain operationally limited for servicing ship-to-shore craft, especially during military operations. These platforms are subject to craft interface instabilities, limited docking area for the ship-to-shore craft, and limited flexibility of cargo placement within the platforms. Several designs are known for landing platforms, however, these designs generally remain limited for cargo replenishment and other operations of ship-to-surface craft.

There is a need in the art to provide landing platforms that minimize difficulties of host vessel to ship-to-shore craft interface instabilities, for air-cushion type vessels and craft, while retaining the capability of servicing multiple ship-to-shore craft at a given time. The present invention addresses this and other needs.

SUMMARY OF THE INVENTION

The present invention includes a platform for interfacing host vessel and ship-to-shore craft operations comprising a water buoyant surface for transport on a host vessel, an angled deck within the surface and at least an inner ramp and an outer ramp within the platform, the ramps extending into the water from the angled deck for receiving ship-to-shore craft effectively for operational support of the ship-to-shore craft from the host vessel.

The present invention also includes a method for interfacing a host vessel and ship-to-shore craft comprising the steps of providing the above-identified platform, placing the platform alongside of the host vessel, and then, docking ship-to-shore craft to the platform. The present invention is particularly useful with two platforms being formed together as a stern platform servicing a host vessel.

The angled landing platform of the present invention is particularly applicable for shipboard alongside operations of both air cushion vehicles/nondisplacement-hull type landing craft as well as with displacement-hull type landing craft or vessels.

DETAILED DESCRIPTION OF THE PREFERRED EMBODIMENT

The present invention provides for an angled landing platform (ALP) particularly suited to provide a means for Air Cushion Vehicles (ACVs)/non-displacement landing craft (NDLC), displacement landing craft (DLC) and amphibious vehicles to safely come alongside larger replenishment or command vessels, particularly those vessels not configured with a well deck. The angled landing platform allows such configured vessels to operate in support of roll-on/roll-off (RO/RO) and load-on/load-off (LO/LO) operations. Representative examples of the waterborne vehicles include the United States Navy's Landing Craft Air Cushion (LCAC). The present invention further provides a means for displacement craft, such as the 1646 Class Landing Craft Utility (LCU) type naval vessel and the United States Army's LCU-2000, to safely come along side a vessel, in support of RO/RO and LO/LO operations. The present invention allows the LCAC to approach, hover, and land on the angled landing platform from an oblique angle to the host vessel, thereby allowing the craft operator greater control to potentially mitigate possible damage that could occur to the craft's control and personnel modules, propulsion modules, and propeller shrouds than if the craft were required to transit alongside and thus in close proximity to the host vessel in its approach to an alternate type landing platform.

Figure 1:
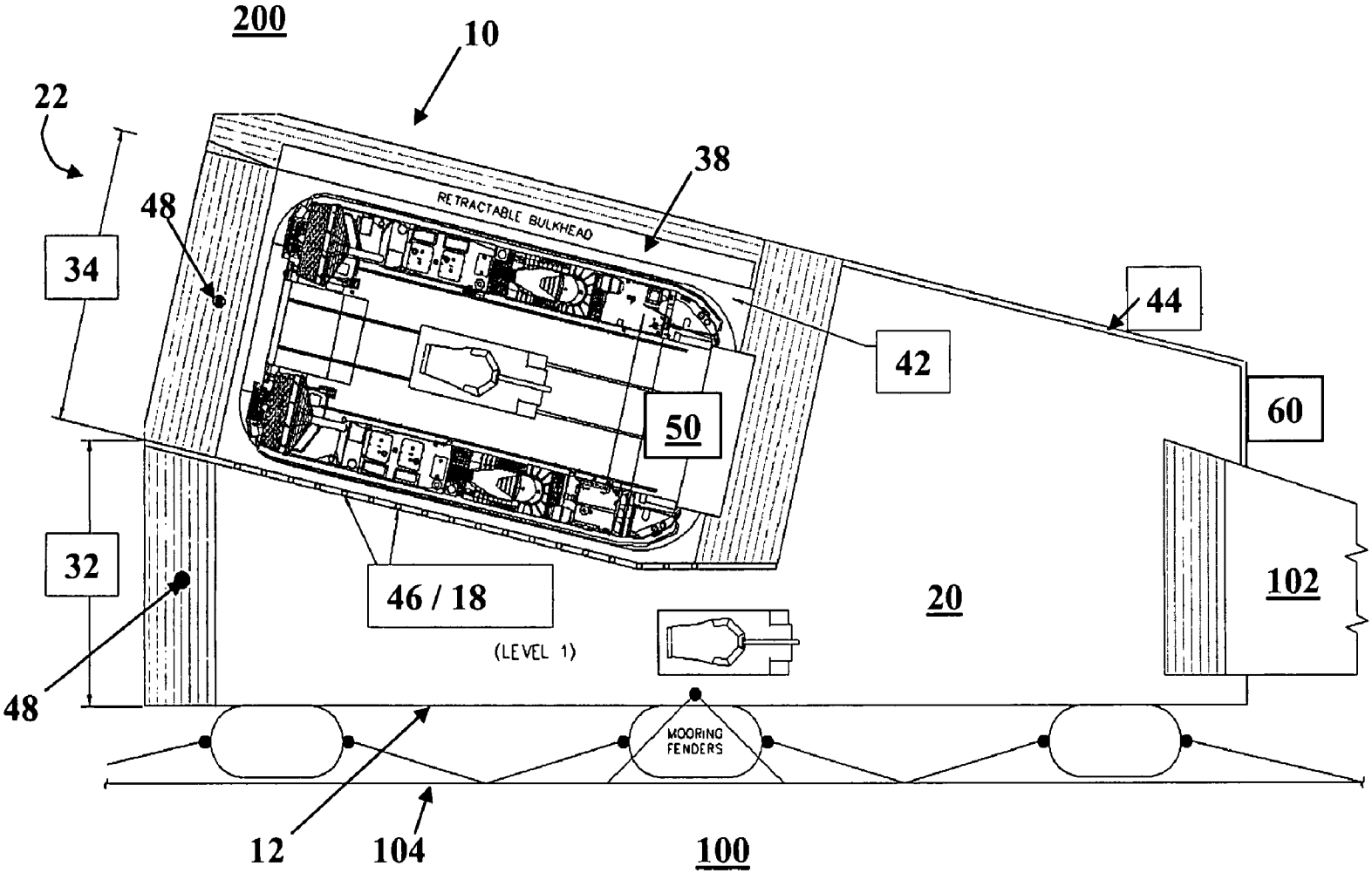
FIG. 1 illustrates a top down view of an angled landing platform of the present invention.

The present invention includes a novel platform for interfacing host vessel and ship-to-shore craft operations. Referring to FIG. 1, the platform 10 includes a water buoyant surface 20 having an angled deck 22 within the surface 20. The platform 10 further includes inner 32 and outer 34 ramps within the platform 10. These ramps 32 and 34 are positioned to accommodate service onto the platform 10 from a host vessel 100 where the ramps 32 and 34 extend into the water 200 from the angled deck 22 for receiving ship-to-shore craft 50 in a manner that provides effective operational support of the ship-to-shore craft 50 from the host vessel 100. Both service ramps 32 and 34 are of sufficient width to accommodate the width of a variety of landing craft, up to and including the LCU-1646 class, the future proposed LCU Replacement craft, the LCU-2000, as well as a multitude of smaller landing craft, such as the LCM-8. The platform 10 is constructed with two levels, such that the landing area forward of service ramp 34 is at a lower level to the water (i.e. lower freeboard) than the landing area in front of service ramp 32. In addition, amphibious tracked vehicles such as the USMC's Amphibious Assault Vehicle (AAV) and their future Expeditionary Fighting Vehicle (EFV) can enter the water through either of the two ramps 32 and 34. The forward bulwark 44 can accommodate the securing of any safety boats or security craft. Representative sizes of the platform 10 include the platform 10 having a surface with a total surface area of from about 5000 square feet to about 12000 square feet and a total displacement of from about 1 ton to about 20 tons. Other sizes and weights are readily possible, and generally conform to the dimensions of the landing craft 50 and host vessel 100 size, with determination of proper sizes of the platform 10 determinable by those skilled in the art of landing craft operations.

Figure 2:
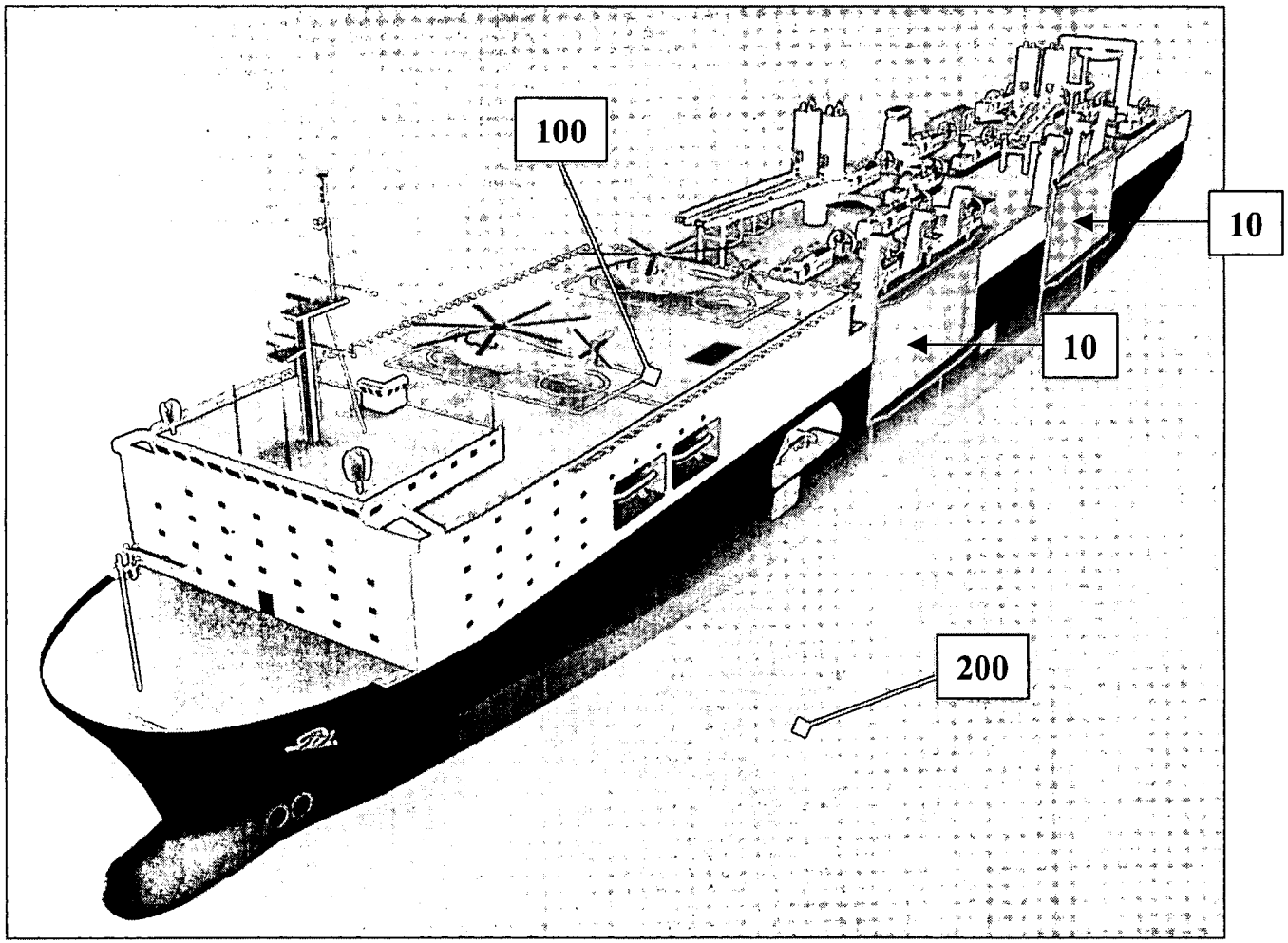
FIG. 2 illustrates the transport of two notional angled landing platforms of the present invention mounted and stowed on the port side of the host vessel.

In operation, the above-identified platform 10 interfaces the host vessel 100 and ship-to-shore craft 50 when the platform 10 is placed alongside of the host vessel 100 and ship-to-shore craft 50 are docked on the platform 10. Typically, the angled landing platform 10 includes a non-powered, displacement platform that is stowed along the port or starboard sides of the host ship 100 during open ocean transits. However, in a preferred embodiment the platform 10 includes a positioning propulsion mechanism 60. As seen in FIG. 2, two (2) notional angled landing platforms 10 of the present invention are shown in a stowed position along the port side of the host vessel 100 during underway operations, such as open ocean transits. Additional angled landing platforms 10 may exist on the starboard side of the host vessel 100, or in the aft section of the vessel 100. In this flush configuration with the hull of the host vessel 100, the angled landing platforms 10 are less subject to damage during the ship's transit, and are less likely to cause damage or drag to the ship 100. Once the ship 100 has stopped, such as being at anchor, and angled landing platform 10 use is needed, the angled landing platforms 10 are lowered from the side of the host vessel 100 into the water 200 using high-capacity winches. As the lower edge of the platform 10 enters the water 200, the angled landing platform 10 commences to drift outboard until the platform 10 is fully horizontal in the water 200. Once in the water, the platform 10 is placed alongside of the host vessel 100, such as on its port or starboard side or stern. The platform 10 may be used as a singular unit or married to a second platform 10 (described below). When operations are complete, the craft 50 are separated from the platform 100 and the platform 100 is raised into the hull of the host vessel 100 for transport.

Figure 3:
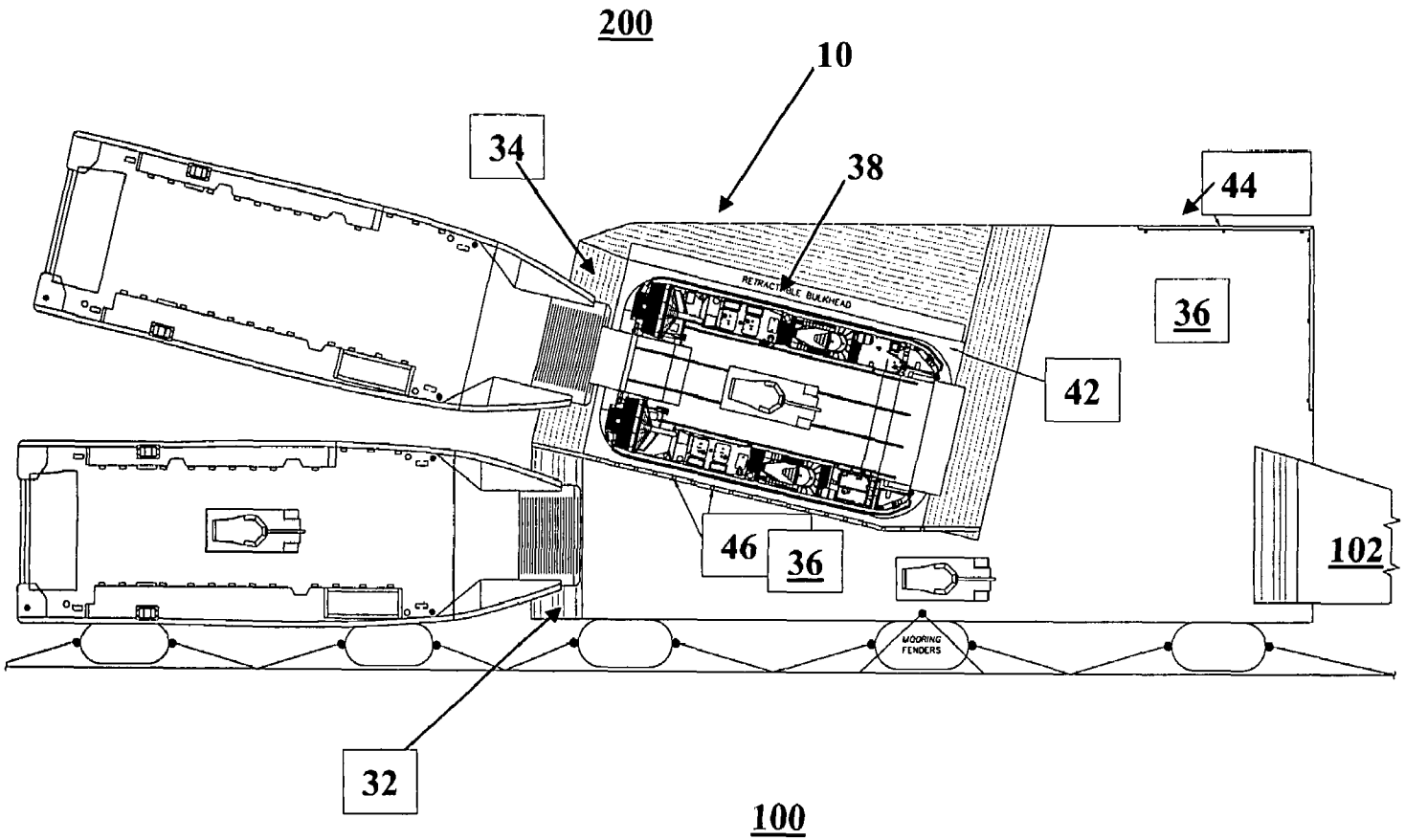
FIG. 3 illustrates a top down view of cargo transfer operations between a displacement-hulled vessel such as Landing Craft Utility (LCU) and a nondisplacement-hulled vessel such as the Landing Craft Air Cushion (LCAC) using an angled landing platform of the present invention.
Figure 4:
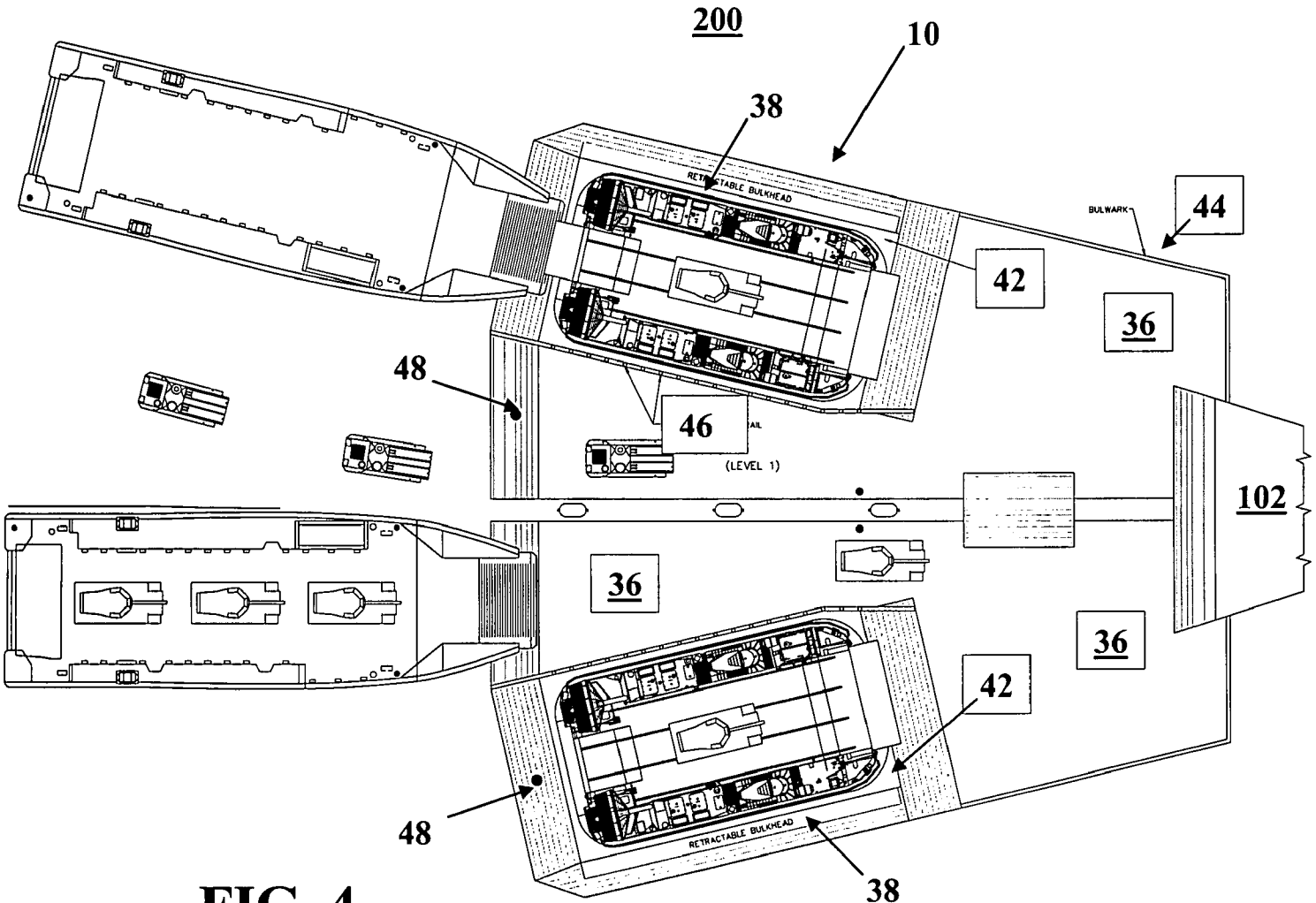
FIG. 4 illustrates a top down view of two angled landing platforms of the present invention secured together to support stem ramp operations; and, FIG. 5 illustrates a top down view of an angled landing platform with retractable guard rail for lateral Landing Craft Air Cushion egress.

Referring to FIGS. 3 and 4, an angled landing platform 10 of the present invention, such as one or more of the angled landing platforms 10 shown in FIG. 1, has been lowered from a stowed position shown in FIG. 2 into the water alongside the port side (FIG. 3) or at the stern (FIG. 4) of the host vessel 100. Propulsion mechanisms incorporated into the angled landing platforms 10 may provide relative ease of transit between host vessels 100, transit around a host vessel 100, e.g., for marrying two angled landing platforms 10 together, pivotally maneuvering the angled landing platform 10 in place next to the host vessel 100, etc. Referring to FIG. 3, a side port door (not shown), mounted low on the host vessel's hull structure is opened and an integral folding ramp structure 102 is extended to contact the deck of the floating angled landing platform 10. The host vessel's side-port ramp extends and rests on the forward edge of the platform 10. The side-port ramp's integral folding ramp 102 has an angled outboard geometry (i.e., flared configuration) that mover. FIG. 4 shows two platforms 10 connected together at the stern of the host vessel 100 with a broad folding ramp structure 102 providing access to each component platform 10. In an alternative embodiment, the folding ramp structure 102 may be integrated into the structure of the platform 10 and extended from the platform 10 to the host vessel 100. Rolling stock is then driven from the interior of the host vessel 100 onto the angled landing platform 10 through this large stern ramp arrangement.

As seen in FIG. 4, the platform 10 has two distinct levels, an upper level 36 and lower level 42, with inner ramp 32 rising to a high freeboard and outer ramp 34 rising to a lower freeboard. With this multi-level construction, level 36 and level 42, along the edge of where the two ramps 32 and 34 meet, a vertical bulkhead 46 is naturally created due to the difference in deck heights/freeboard. Along the forward edge of the outer ramp 34 is a staging area, such that wheeled and/or tracked vehicles or Material Handling Equipment (MHE) can readily transit between the two distinct levels. As further seen in FIGS. 1 and 3, the platform 10 incorporates two primary mooring ramps 32 and 34. The longitudinal centerline of outer ramp 34, referred to herein as the line of axis, has an angled configuration relative to the abutting edge of the platform 10 to the host vessel 100 (shown in FIG. 1 as the abutting side 12 of the platform 10 to the side 104 of the host vessel 100), The inner ramp 32 is constructed with a line-of-axis that is parallel to the host vessel, while the outer ramp 34 is constructed with a line-of-axis that is at an oblique angle to the host vessel 100. Representative angular offsets of the outer ramp 34 include, for example, from about 10 degrees to about 50 degrees from the centerline of the host vessel 100, with an angle from about 20 degrees to about 40 degrees preferred. The outer ramp 34 has a distinct lower level relative to the inner ramp 32. The construction of the platform 10 is such that ramp 34 provides the foundation for a landing spot for ACV and NDSL type landing craft such as the LCAC. The lower freeboard of the deck level at ramp 34 facilitates the shallow ramp approach angle useful for ACV/LCAC docking when climbing onto the platform 10. The platform 10 incorporates an angular approach angle leading to ramp 34 for LCAC operations allowing the LCAC craftmasters sufficient room, both to port and to starboard, to execute a turn if they lose control of the craft 50 while attempting to climb the ramp 34.

Both ramps 32 and 34 incorporate a fitting in the ramp deck to permit the installation of a large diameter pin/receiver 48 that protrudes several inches above the ramp surface. U.S. based displacement type landing craft have a through-hole in their bow ramps. This through-hole is meant to engage this protruding pin 48, and thus allow the bow ramp of the landing craft to be secured to the aft ramp(s) of the platform 10. The ship-to-shore craft 50 are docked to the platform 100 by inserting the docking pin between the ship-to-shore craft 50 and platform 10 to secure the ship-to-shore craft 50 to the platform 10. The outer ramp 34 may include one or more docking pin receivers 48 for retaining a ship-to-shore craft 50 to the platform 10. As further seen in FIGS. 3 and 4, the incorporation of an outer (second) ramp 34 with its own ramp engagement pin allows other landing craft, such as an LCU, to be secured to the platform 10 while an LCAC is positioned forward at outer lower deck 42. Tactically this is advantageous as combat cargo can continue to be loaded or discharged from the aft LCU, by driving through the off-cushion LCAC. With this configuration, combat cargo operations can still be supported should a disabled or maintenance-burdened LCAC arrive at the platform 10. In addition, combat cargo, from the aft LCU, can be driven directly onto the LCAC and secured, with the combat cargo facing forward on the LCAC.

As further seen in FIG. 4, the platform 10 is particularly useful as a combination of platforms comprising multiple platforms 10 held together. When two platforms are married together, the two platforms 10 are preferably substantially mirror-images of each other. In a particularly preferred embodiment, two substantially mirrored-imaged platforms 10 are fixed together and placed at the stem of the host vessel 100. One platform 10 can be constructed as a mirror image to the other, such that one platform 10 can be transported and operated from the port side of the vessel, while the other can be transported and operated from the starboard side. Under this design approach, two platforms 10 can be placed on their respective sides of the host vessel 100 or repositioned towards the aft section of the vessel 100 and secured together to support stem ramp RO/RO operations. As seen in FIG. 4, this approach allows for up to four vessel-loading ramps to be available for RO/RO operations along with two LCAC landing spots. Under this condition, the heavy stem ramp of the host RO/RO vessel may rest on the leading edge of both platforms 10, with a smaller cargo transfer ramp being connected between the two platforms 10. This transfer ramp preferably provides a platform-to-platform securing device.

Displacement hulled vessels approaching the platform 10 may conveniently approach and dock along the aft ramp section of the platform 10. Once adjacent and head-on to the aft ramp section of the platform 10, the displacement hulled vessels can lower their bow ramps to engage the aft ramp section of the platform 10 that is facing the displacement hulled vessels. Alternatively, displacement hulled vessels can come alongside the platform 10 and be secured to the outboard edge (e.g., away from the host vessel 100) of the platform 10 using mooring lines or other known mooring device. During use of the angled landing platform 10, relative positioning of the host vessel 100 to the angled landing platform 10 may be changed or repositioned to minimize sea state, wave and wind effects on cargo operations ongoing on the integrated landing platform 10. The host vessel 100 may use a dynamic positioning system to maneuver the host vessel 100 and create a semi-protected environment on the leeward side of the host vessel 100. As such, the host vessel 100 intentionally blocks the waves and or wind by using its overall mass, waterline length and freeboard, to reduce the waves and wind in the immediate area of the angled landing platform 10.

For air cushion vehicles, e.g., LCAC, operations, the LCAC transits along the side of the host vessel 100 approaching the aft part of the integrated landing platform 10, drives up the aft ramp section of the integrated landing platform 10 where the LCAC hovers and comes off-cushion in the center of the angled landing platform to discharge or receive cargo. Departure of the LCAC from the angled landing platform 10 may occur by either backing-down over the aft ramp section of the integrated landing platform 10 or over the side retractable bulkhead 38, discussed below. Ingress on and egress off the platform 10 is facilitated with the use of this angled outer ramp 34 in conjunction with the inner ramp 32 and a serviceable positioning area in the form of a forward loading ramp 102 extendable from the host vessel 10 to the top of the platform 10. Placement of the forward loading ramp 102 allows transit of goods from the host vessel 100 to both ramps 32 and 34 concurrently. Preferably, the forward loading ramp 102 includes an increasing width from the host vessel 100 to the platform 10 effective for vehicular movement of extended-length vehicles and vehicles with trailers in tow.

Once the LCAC has left and the integrated landing platform 10 operations are complete, the vessel's integral folding ramp 102 is retracted and the vessel's side-port is closed and secured. The angled landing platform 10 is then hoisted up the side of the host vessel 100 for storage, in a like manner as previously shown in FIG. 2 showing two (2) notional angled landing platforms 10 in a stowed position along the port side of the host vessel 100 for transit.

The angled landing platform 10 of the present invention includes multiple subsystems for operational utility and safety of the air cushioned vehicles, such as the LCAC, for the air cushion vehicles to approach, climb-up, hover on and depart the angled landing platform while floating and alongside the host vessel 100. These and other subsystems additionally support concurrent cargo loading and discharge operations with multiple cargo and support vessels from the angled landing platform 10.

Low retaining bulkheads 38 may be present on both the port and starboard side of the angled landing platform 10 confining the docking craft 50 while it is on the top of the angled landing platform 10. Preferably, the platform 10 includes an outward bulwark 38 adjacent to the side of the outer ramp 34 side that is away from the inner ramp 32. More preferably, the outward bulwark 38 is retractable. Other partition components may be included, such as a dividing bulwark 46 between the inner 32 and outer 34 ramps, with the dividing bulwark 46 preferably including venting ducts 18. Additionally, an outboard bulwark 44 of the platform 10 is preferably designed to deflect waves striking the forward section of the platform 10 versus a flat-faced bulwark which typically receives high-impact forces from advancing seas. Under extreme sea conditions, watercraft 50 moored at the inner ramp 32 is protected from direct wave impacts by the combined barrier effect created by the outer bulwark in addition to both sidewalls of the outer ramp 34 that constitutes a LCAC landing spot.

The platform 10 of the present invention provides novel LCAC approaches to the platform 10, including LCAC approach, hovering and egress operations. In addition to having a lower freeboard at outer ramp 34 for improved approach angles, relative to the platform's freeboard, the bulkhead 46 that forms the inboard guard-rail is formed from the deck height difference between upper deck 36 and lower deck 42. The height of the inboard guard rail is preferably increased by the addition of a fixed rail structure. The outboard guard rail 38 preferably has a retractable design/construction.

In air cushion vehicle operation, mass airflow is directed beneath the air cushion vehicle and retained by a skirt that is draped around the edge of the air cushion vehicle. This provides a low-pressure air bubble on which the air cushion vehicle is riding. When excess air is allowed to free-flow from under and away from the skirt, the craft experiences very little oscillating effects. If the excess airflow is impeded from venting from one side of the craft, such as when the skirt is rubbing and compressing against a lateral bulkhead, the excess airflow is typically forced to vent out the opposing skirt side. This larger than normal airflow causes a sudden drop in the skirt pressure on that side and the craft rolls toward the side that is now experiencing venting. When the craft rolls, the skirt again comes into contact with the opposing bulkhead, causing airflow on this opposing side, to now be entrapped and inducing venting on the opposing side. This phenomenon continues as long as the craft is operating in a confined space and can induce huge oscillations that can induce tremendous damage to the craft and/or host vessel structure.

The lower edge of both guard rails 38 and 46 are preferably cut or vented to allow LCAC air-pressure to vented from around the base of both guard rails 38 and 46. Venting mechanisms on the inner surface may include any appropriate means to relieve LCAC air pressure, such as having the bumper guards extended out from the bulkhead a sufficient distance to allow LCAC skirt air flow to escape under the bumpers and relief vertically along the back-side of the bumpers, or having vent holes cut through the inboard bulkhead and have the LCAC airflow escape through ducts/ channels underneath the upper deck 36 area. The venting of the LCAC skirt pressure along the outboard retractable bulkhead/guard rail can also be achieved using any appropriate method, such as having a guard rail with lattice construction which will naturally allow venting of excess air flow. Venting of the excess air that is escaping from around the edge of the LCAC skirt mitigates the oscillating effects when an air cushion vehicle is transiting through a narrow lane or hovering in a confined space.

Figure 5:
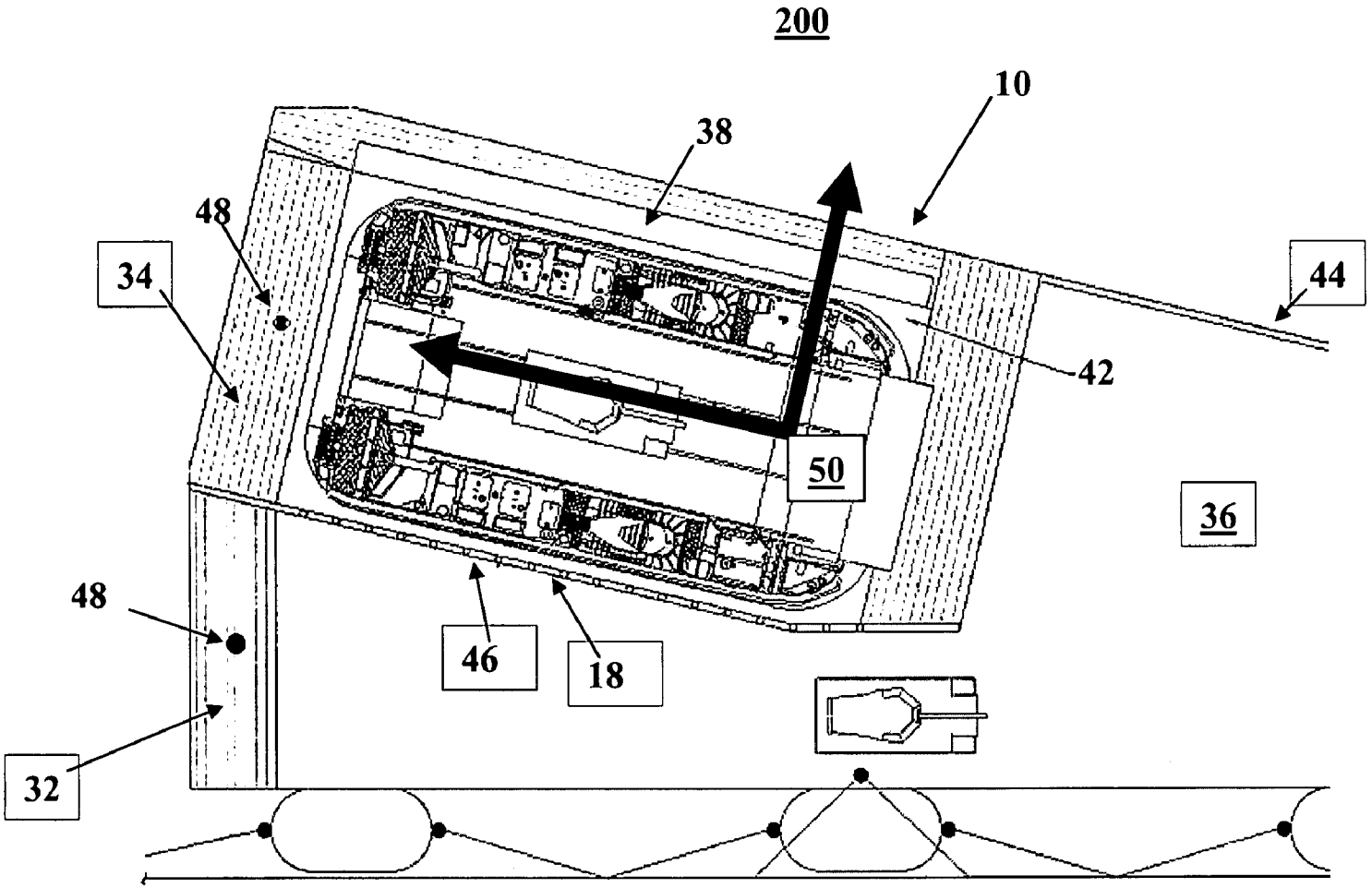

The platform 10 of the present invention preferably uses the retractable bulkhead 38 for LCAC operations. Under normal operating conditions, the LCAC comes up the outer ramp 34 and set-down on the lower deck 42. Once cargo transfer is complete, the LCAC powers-up, goes on-cushion and backs down the outer ramp 34. Under heavy sea conditions, the LCAC has a tendency to slide rearward down a ramp with the high potential that the craft air propellers would ingest water and shatter, inducing a major casualty to the craft. Use of the retractable bulkhead 38 of the platform 10 reduces the risk of an LCAC egressing a platform 10 under adverse sea conditions. As seen in FIG. 5, once the air cushion vehicle is on-cushion, the craftmaster can execute a lateral departure into the seas, subjecting the bow and forward side of the air cushion vehicle to the initial sea conditions instead of the vulnerable stem section (and propellers) of the air cushion vehicle. Additionally, lateral departures may be employed when other cargo vessels are moored to the approach of the outer ramp 34 and the LCAC needs to depart. Retractable bulkheads 38 may be powered by any appropriate mechanisms to allow the outboard bulkhead/guard rail 38 to retract, collapse, deflate or drop-down to allow lateral egress by an LCAC. Suitable mechanisms may include mechanical locks with spring return, such that the force generated by the LCAC, against the guard rail 38 can be used to push the rail structure down, while springs return it to the vertical position after the LCAC is clear; hydraulic-driven or electric-driven actuators to lower and raise the rail 38; pneumatic-driven cylinders or expanding bellows systems, and the like. Additionally, the outboard bulkhead 38 may be retracted by collapsing the rail 38 in a linear direction. Other retractable rail 38 designs may include inflatable construction, such that the bulkhead 38 is inflated to serve as a retaining bulkhead 38 during normal LCAC operations and is deflated when required for lateral departure operations. As such, the LCAC rides over the deflated structure without running the risk of damaging itself on the now deflated bulkhead 38.

The platform 10 of the present invention improves the operational safety, operational utility, and increases the cargo throughput rate of material being transferred from a host vessel 100 to a variety of waterborne cargo craft as compared to non-angled landing platforms. The platform 10 of the present invention is applicable for a large variety of displacement hull type craft, air cushion vehicles, as well as tracked (or wheeled) amphibian vehicles. The platform 10 provides a means for simultaneous LCU and LCAC loading and discharge operations on a vessel without a well deck configuration. Additionally, amphibious tracked vehicles may safely and efficiently conduct water entry and water egress operations while alongside a non-well deck configured vessel, as part of a RO/RO operation. Cargo transfer between the bow ramp of an LCU and the stem ramp of the LCAC is readily facilitated, as is the placement of a disabled LCAC to be serviced along side a host support vessel, while removing and/or minimizing the impact to other additionally facilitated with the presence of the skirt venting system incorporated into a landing platform that mitigates the severe craft oscillating effects induced by hovering ACVs while operating in confined spaces. The platform 10 provides a safer and efficient work area for supporting alongside refueling operations of the landing craft, including hotel services, such as power and water. The multi-tiered, angled landing platform 10 of the present invention significantly mitigates host vessel to ship-to-shore craft interface instabilities, while retaining the capability of concurrently operating and servicing multiple ship-to-shore craft. For purposes of illustration only, non-limiting examples of how the present invention may be utilized are presented.

EXAMPLE 1

An angled landing platform, in the form of a non-powered, displacement platform, is stowed alongside the port side of a host ship during open ocean transits. With the arrival of the host vessel for waterborne cargo loading operations, high-capacity winches lower the platform to the water's edge. As the lower edge of the platform enters the water, the platform commences to drift outboard from the host vessel until the platform is fully horizontal in the water. The platform is pushed adjacent to the port side of the host vessel and fixed aft of a side port hatch of the host vessel. The side port hatch, mounted low on the vessel's hull structure is opened and an integral folding ramp structure is extended to contact the forward deck section of the floating platform. Rolling stock is then driven from the interior of the host vessel to the platform through this side port and ramp arrangement.

EXAMPLE 2

Two angled landing platforms, in the form of non-powered, displacement platforms, are stowed alongside the port (1 platform) and starboard (1 platform) sides of a host ship during open ocean transits. The host ship does not have a well deck. With the arrival of the host ship for waterborne cargo loading operations, high-capacity winches lower the platforms to the water's edge. As the lower edge of each of the platforms enters the water, the platform commences to drift outboard from the host vessel until the platform is fully horizontal in the water. Both lowered platforms are towed to the stem of the host vessel where the two platforms are joined together. An aft hatch, mounted low on the vessel's hull structure is opened and an integral folding stem ramp structure is extended to contact the forward deck sections of the combined floating platforms. In support of RO/RO and LO/LO operations a LCAC approaches, hovers, and lands on the angled landing platform from an oblique angle to the host vessel (to mitigate possible damage to the LCAC and other craft moved to or parked on the platform) and rests on the outboard lower deck. Displacement craft, such as the 1646 Class Landing Craft Utility (LCU) type naval vessel and the United States Army's LCU-2000 are brought headlong to the inner and outer ramps and secured using a pin. Rolling stock is then driven from the interior of the host vessel to the platforms through this aft ramp arrangement while simultaneous LCU and LCAC loading and discharge operations are conducted on the platform. The rolling stock can pass through the LCAC and onto the outer ramp LCU for loading. Refueling operations, along with other hotel services, such as power and water is provided to the watercraft. After loading is complete, the LCU at the inner ramp is released to service and amphibious tracked vehicles conduct water entry and water egress operations at the inner ramp as part of RO/RO operations. With an increase in adverse sea conditions, the LCAC departs (launches) laterally into the sea to avoid the risk of backing-down the ramp and subjecting the stem mounted propellers to wave ingestion.

The foregoing summary, description, and examples of the present invention are not intended to be limiting, but are only exemplary of the inventive features which are defined in the following claims.

What is claimed is:

1. A platform for interfacing host vessel and ship-to-shore craft operations, comprising:

a water buoyant surface for transport on a host vessel;

an angled deck within the surface; and, at least an inner ramp and an outer ramp within the platform, located on two separate working deck levels at different elevations on the angled deck, the ramps extending into the water from the angled deck for receiving ship-to-shore craft effective for operational support of the ship-to-shore craft from the host vessel.

2. The platform of claim 1, wherein the outer ramp is at a lower working deck level than the inner ramp.

3. The platform of claim 1, wherein the outer ramp is angled from about 10 degrees to about 50 degrees from the centerline of the host vessel.

4. The platform of claim 2, wherein the outer ramp is angled from about 20 degrees to about 40 degrees from the centerline of the host vessel.

5. The platform of claim 1, wherein the platform further includes one or more docking pin receivers on the outer ramp effective for retaining a ship-to-shore craft to the platform.

6. The platform of claim 1, further comprising an outward bulwark adjacent to the side of the outer ramp, away from the inner ramp.

7. The platform of claim 6, wherein the outward bulwark is retractable.

8. The platform of claim 1, further comprising a dividing bulwark between the inner and outer ramps, created by the meeting of the two working deck levels.

9. The platform of claim 8, wherein the dividing bulwark includes venting ducts.

10. The platform of claim 1, wherein the surface has a total surface area of from about 5000 square feet to about 12000 square feet.

11. The platform of claim 1, wherein the platform has a total displacement of from about 1 ton to about 20 tons.

12. The platform of claim 1, further comprising a forward loading ramp extendable from the host vessel to the surface.

13. The platform of claim 12, wherein the forward loading ramp includes an increasing width from the host vessel to the surface effective for vehicular movement of extended-length vehicles.

14. The platform of claim 1, further comprising an intermediate ramp between the inner ramp and outer ramp.

15. The platform of claim 1, further comprising a positioning propulsion mechanism.

16. A method for interfacing a host vessel and ship-to-shore craft, comprising the steps of:

providing a platform for interfacing host vessel and ship-to-shore craft operations having a water buoyant surface for transport on a host vessel, an angled deck within the surface and at least an inner ramp and an outer ramp within the platform, at least two different working deck levels, the ramps extending into the water from the angled deck for receiving ship-to-shore craft effective for operational support of the ship-to-shore craft from the host vessel;

placing the platform alongside of the host vessel; and docking ship-to-shore craft to the platform.

17. The method of claim 16, wherein the step of placing the platform alongside of the host vessel includes lowering the water buoyant surface from the host vessel.

18. The method of claim 16, wherein the step of placing the platform alongside of the host vessel includes marrying two platforms together at the stern of the host vessel.

19. The method of claim 16, wherein the step of docking ship-to-shore craft to the platform includes inserting a docking pin between the ship-to-shore craft and platform to secure the ship-to-shore craft to the platform.

20. The method of claim 16, further comprising the step of raising the water buoyant surface into a stowed position on the hull of the host vessel for transport.

* * * * *